United States Patent [19]

Menchetti

[11] Patent Number: 5,058,354

[45] **Date of Patent: * Oct. 22, 1991**

[54] PANELS WITH LAMINATED STRIPS FOR CLIPS

[75] Inventor: Robert J. Menchetti, Buffalo, N.Y.

[73] Assignee: National Gypsum Company, Dallas, Tex.

[ * ] Notice: The portion of the term of this patent subsequent to Dec. 11, 2007 has been disclaimed.

[21] Appl. No.: 590,736

[22] Filed: Oct. 1, 1990

Related U.S. Application Data

[60] Division of Ser. No. 410,449, Sep. 21, 1989, Pat. No. 4,995,215, which is a continuation-in-part of Ser. No. 299,200, Jan. 23, 1989, Pat. No. 4,976,083.

[51] Int. Cl.[5] ..... E04B 2/58

[52] U.S. Cl. ..... 52/486; 52/489; 52/511

[58] Field of Search ..... 52/481, 486, 489, 511, 52/747; 428/131

[56] References Cited

U.S. PATENT DOCUMENTS

| | | | |
|---|---|---|---|
| 1,810,597 | 6/1931 | Corwin | 52/489 |
| 2,082,314 | 6/1937 | Venzie | 52/486 X |
| 2,480,241 | 8/1949 | Hensel | 52/486 |
| 3,621,635 | 11/1971 | Lange | 52/486 X |
| 3,948,011 | 4/1976 | Price et al. | 52/481 |
| 4,128,979 | 12/1978 | Price | 52/481 |
| 4,245,448 | 1/1980 | Agar | 52/489 |
| 4,263,764 | 4/1981 | Wendt | 52/486 X |
| 4,310,580 | 1/1982 | Sachse | 428/131 X |
| 4,525,399 | 6/1985 | Fields | 428/131 X |

FOREIGN PATENT DOCUMENTS

| | | | |
|---|---|---|---|
| 544498 | 5/1957 | Canada | 52/486 |
| 2606726 | 3/1977 | Fed. Rep. of Germany | 52/486 |

*Primary Examiner*—John E. Murtagh
*Assistant Examiner*—Deborah McGann Ripley
*Attorney, Agent, or Firm*—Laird F. Miller; Robert F. Hause

[57] ABSTRACT

A gypsum wallboard suspension system in which the wallboard has a tear-resistant material partially adhered to the back face, with small slots in the material located at unadhered areas, through which small suspension clips are inserted. The clips include a hanger leg for hanging the clip on horizontal channels, which are part of the wall framing system.

13 Claims, 4 Drawing Sheets

PANELS WITH LAMINATED STRIPS FOR CLIPS

This application is a divisional application of my copending application, Ser. No. 07/410,449, filed Sept. 21, 1989, which application was a continuation-in-part of my copending application, Ser. No. 07/299,200, filed Jan. 23, 1989.

FIELD OF THE INVENTION

The present invention relates to a demountable wall panel, to a hollow, demountable wall made therefrom, to a method of mounting wallboard, and more particularly to a predecorated wallboard having adhered on the wallboard back face a thin sheet of relatively tear-resistant material with a plurality of openings in the tear-resistant material located at unadhered areas, for the reception of small rigid clips which provide the means for affixing the wallboard to the wall framing system.

BACKGROUND OF THE INVENTION

A common method of affixing demountable predecorated gypsum wallboard to a metal framework, in constructing a hollow interior partition wall, is disclosed in U.S. Pat. No. 4,245,448, wherein a small metal plate with bent-out, sharp, piercing tangs is affixed to a wallboard back face by driving the tangs through the wallboard back face paper, into the interior gypsum core, in a manner similar to a gang nail plate being affixed to a wooden rafter.

These gang nail plates are somewhat expensive, they must be handled separately and delivered to the building contractor separately, they must be affixed to the wallboard by the builder as a separate time consuming step, and their use involves the possibility of the builder applying the clips in the wrong position or in a manner which damages the wallboard. Once affixed to a wallboard, the plates create a problem, by their thickness, rigidness and small size, when a large number of such wallboards are demounted and stacked prior to reconstructing the wall in a new location, since the plates tend to damage wallboards when stacks are high enough to place great weight on the boards near the bottom of the stack.

U.S. Pat. No. 1,810,597 discloses an elongate metal strip which is attached, by tangs, or nails or screws, to the back face of a wallboard in a factory. The metal strip includes a plurality of tongues which extend outward in position to cooperate with a plurality of openings in the face of a specially adapted metal stud.

This metal strip is also somewhat expensive, and presents the problem of damage possibly occurring to the wallboard as the strip is being fastened to the wallboard. This strip would also create a problem in stacking the boards, after manufacture in the factory, or after demounting of the wallboards for relocating the wall, due to the protruding tongues.

SUMMARY OF THE INVENTION

The present invention involves a gypsum wallboard which has thin, flexible, tear-resistant material adhesively affixed to the wallboard back face. This thin material, which is preferably a laminated material consisting, for example, of a continuous fiber-reinforced paper and a thin, open meshed scrim, is adhered to the back face with a plurality of openings at preplanned positions, for the reception of small, angled, support clips. The clips have at least one upwardly extending leg for disposition through one of the openings and at least one outwardly and downwardly extending leg for placement over a wallboard supporting element of the wall framework, such as a horizontal channel. The clips also, preferably, include an intermediate leg which adjoins the upwardly extending leg and the outwardly and downwardly extending leg and results in the outwardly and downwardly extending leg being disposed, adjacent the midsection of the upwardly extending leg. The clips are preferably formed of a rigid sheet metal which has an enlargement in a small area of the top of the intermediate leg and a complementary depression or hole in the immediately adjacent area of the upwardly extending leg, between which depression and enlargement the tear-resistant material is pinched and firmly grasped.

The thin, flexible, tear-resistant material can be applied to the entire back face of the wallboard, it can be applied as small patches at desired locations on the back face, but it is preferably applied in narrow strips, preferably extending lengthwise of the wallboard closely adjacent each side edge of the wallboard, but alternatively extending laterally at a plurality of spaced locations.

It is an object of the invention to provide a novel combination of elements for affixing wallboard to a wall framing system.

It is a further object to provide a combination of a wallboard with a slit fabric adhered to the back and a rigid clip formed to fit through the fabric slits and have an opposite end which is formed to be supported on a horizontal framing member.

It is a still further object to provide a demountable hollow wall in which wallboard is supported on a metal framework by rigid clips which have an outer portion supported on a horizontal framing member and an inner portion extending through slits in a tear-resistant fabric material adhered to the wallboard back face.

BRIEF DESCRIPTION OF THE DRAWINGS

These and other objects and advantages of the invention will be more readily apparent when considered in relation to the preferred embodiments, as set forth in the specification, and shown in the drawings, in which.

DESCRIPTION OF THE PREFERRED EMBODIMENTS

Figure 1:
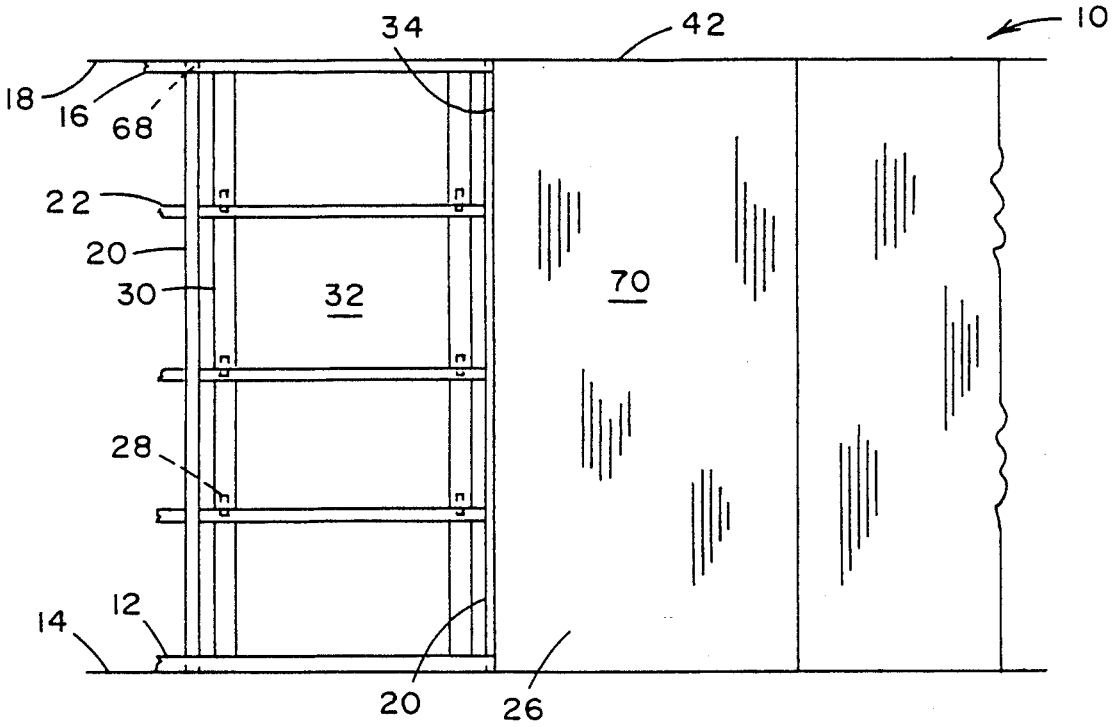
FIG. 1 is a fragmentary elevation of a wall with some of the panels removed to show the framework and wallboard supporting element, all in accordance with the present invention.
Figure 4:
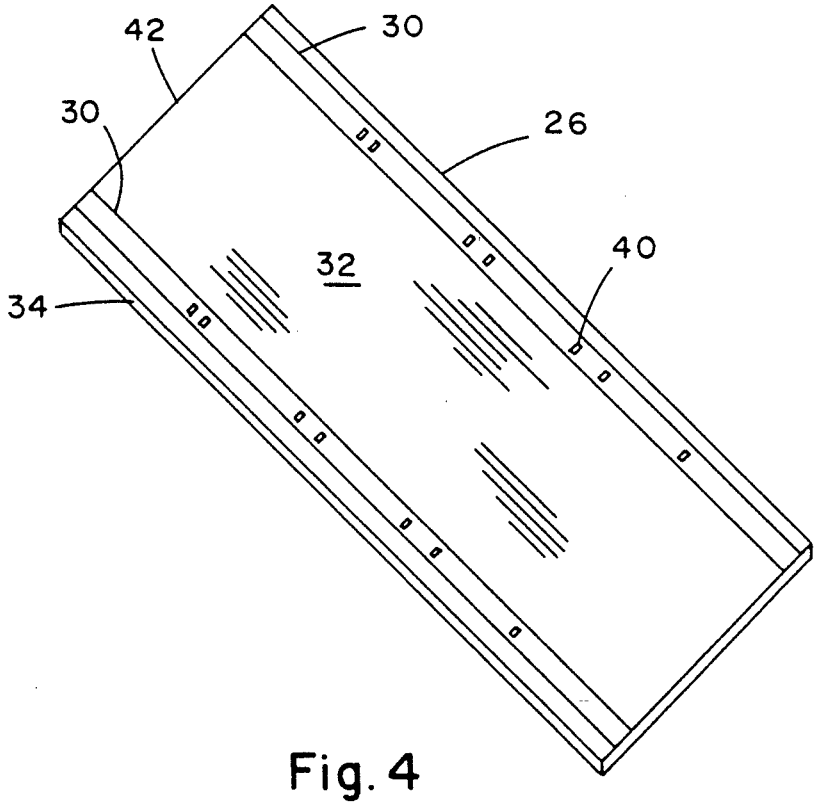
FIG. 4 is an isometric view of the wallboard of FIG. 1 showing the preferred arrangement of fabric strips with a plurality of optional clip receiving slits for use with various ceiling height partition walls.
Figure 2:
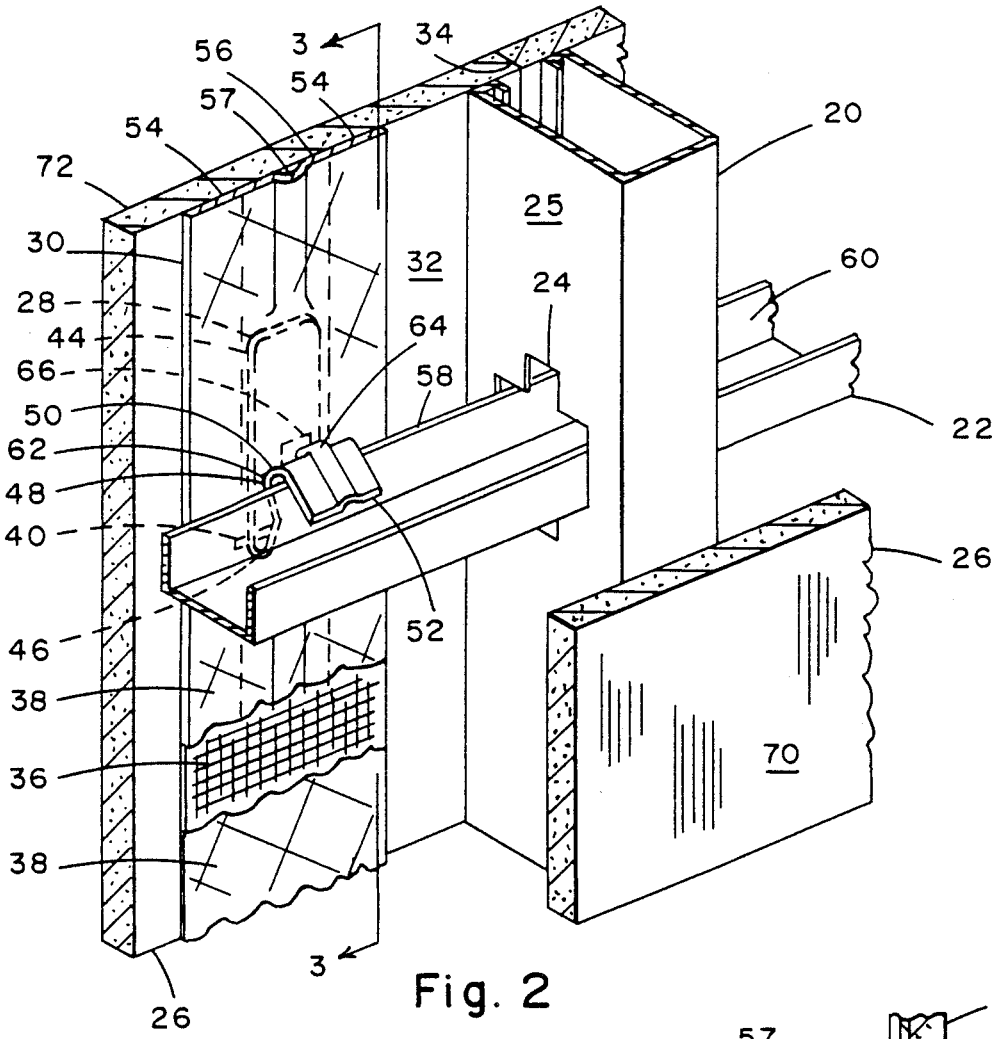
FIG. 2 is a partly broken away, isometric view of a small section of the wall of FIG. 1, showing the wallboard supporting elements.
Figure 3:
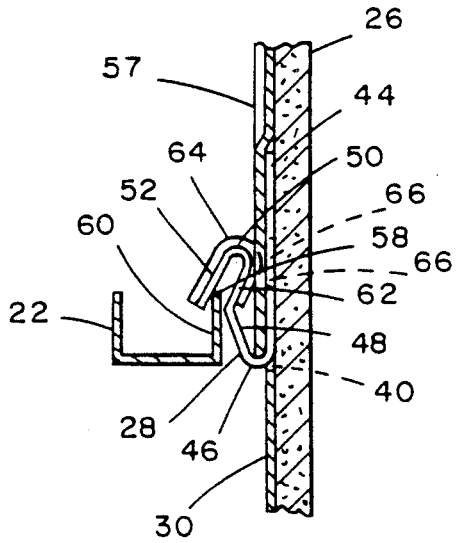
FIG. 3 is a vertical sectional view of the wallboard supporting elements of FIG. 2 taken on line 3—3 thereof.

Referring to the drawings, there is shown a wall 10 including a floor runner 12 mounted on floor 14, a ceiling runner 16 mounted on ceiling 18, vertical, laterally-spaced studs 20 mounted in the floor runner 12 and ceiling runner 16, vertically-spaced horizontal channels 22 extending through horizontally aligned cutouts 24 in the webs 25 of the studs 20, and wallboards 26 which are mounted firmly against both sides of the studs 20, held there by suspension clips 28. Wallboards 26 are preferably paper covered gypsum wallboards.

The wallboards 26 have a novel tear-resistant, slotted, elongate fabric strip 30 partially adhered to the back face 32 adjacent each side edge 34 of each wallboard 26. Tear-resistant strips 30 can be formed of any thin, strong material, but are preferably formed of a thin, laminated composite including a fabric scrim 36 having square-woven, tension-resistant fiberglass threads, eight threads per inch, with threads extending laterally and longitudinally of the elongate strip 30 laminated on each face to fiber-reinforced papers 38, 38 in which the fibers are tension-resistant fiberglass threads arranged in both diagonal directions of the strip 30, spaced-apart at about one-half inch spacings. The fiber-reinforced paper 38 may be made from fiber-reinforced paper tapes which are commonly used in wrapping and sealing large packages.

It is also contemplated that the tear-resistant strips 30 can be formed of other thin, strong materials, including a non-woven, fused, composite layer of a synthetic fiber such as a polyester or polypropylene combined with wood pulp fibers which layer is laminated to a relatively unstretchable 40 to 50 pound Kraft paper; a similar composite layer without the Kraft paper; a non-woven, fused layer of a synthetic fiber such as polyester or polypropylene without wood pulp but laminated to a Kraft paper; a non-woven, fused layer of synthetic fibers such as polyester or polypropylene combined with wood pulp fibers and with fiberglass fibers; any of the above-mentioned layers in which the synthetic fibers have been spun-bonded; any of the above-mentioned layers in which fiberglass fibers with a suitable binder are substituted for the synthetic fibers; any of the above-mentioned layers with a further layer of a woven scrim added to the layer or laminated between two such layers; spun-bonded, non-woven nylon; latex impregnated paper laminated to a Kraft paper; metal screen laminated to a Kraft paper; or a thin metal sheet, such as steel, of about 0.015 inch thickness. In the case of the non-woven examples, the non-woven materials will preferably be of about 3 to 4 ounces per square yard and about 0.018 to 0.023 inch thick. It is contemplated that many other equivalent thin tear-resistant materials may be found suitable for use in accordance with the invention.

The strips 30 can be made from any thin sheet material of any number of plies if sufficient tear resistance can be provided to support the wallboards 26, as will be understood from the following description of the function of the strips 30.

The strips 30, in the preferred embodiment, are about two inches to four inches wide, and are partially adhesively affixed along the full length, of the back face 32. One strip 30 is placed parallel to and spaced inward from one side edge 34 and a second strip 30 is placed parallel to and spaced inward from the opposite side edge 34.

The strips 30 have a plurality of slots 40 extending laterally, having a lateral length of about one inch and a slot width of between about 0 and ¼ inch. The slots 40 are centered laterally of the strips 30 and are spaced apart at a distance which will correspond to the vertical spacing of the horizontal channels 22 of wall 10.

The slots 40 are preferably formed in the strips 30 prior to adhering the strips to the back face 32, however, it is contemplated that the slots 40 could be formed subsequent to adhering the strips 30 to back face 32, even as late as just prior to mounting the wallboards 26, to construct the wall 10.

In the prior construction of partition walls involving suspending wallboard on spaced parallel horizontal channels, such as the structure of the previously discussed U.S. Pat. No. 4,245,448, it has been the practice to employ four horizontal channels at twenty-four-inch spacings, for ten-foot high walls, and three horizontal channels at twenty-six-inch spacings, for nine-foot high walls, measuring the first spacing from the ceiling, or top edge of a wallboard to the bottom of the first channel. Accordingly, the slots 40 in strips 30 are located at spacings from the wallboard top edge 42 of 24 inches, 26 inches, 48 inches, 52 inches, 72 inches, 78 inches, and 96 inches.

The suspension clips 28, which hold the wallboard 26 against the studs 20, are formed of a heavy gauge, one-inch wide sheet metal and include a three-inch long, vertically extending back leg 44 connected at the bottom with a 170° bend 46 to an upwardly extending curved, inch-and-a-half long front leg 48. Front leg 48 is connected at the top with a 150° bend 50 to a downwardly and outwardly extending hanger leg 52, which extends at an angle of about 40° to 60° relative to the vertical back leg 44.

The tear-resistant strips 30, which are partially adhered to the back face 32 of wallboards 26, are adhered very firmly along the two side edge areas 54 with no adhesion of the strips 30 along an elongate central area 56, which central area 56 is substantially equal in width to the laterally extending length of the slots 40. Strips 30 have a raised ridge 57 along the center of central area 56, providing easier insertion of clips 28 through slots 40, as described herebelow.

The back leg 44 of each clip 28 is disposed between the wallboard back face 32 and the tear-resistant strip 30. Each clip 28 extends through a slot 40 at the clip bottom bend 46. Each clip hanger leg 52 is disposed over the top edge 58 of an upwardly extending side wall 60 of a horizontal channel 22.

FIG. 1 shows a nine-foot high wall 10, with three channels 22 spaced respectively 26 inches, 52 inches and 78 inches downward from the wallboard top edge 42, and with three clips 28 having clip bottom bends 46 extending through slots which are also spaced respectively 26 inches, 52 inches and 78 inches downward from the wallboard top edge 42. The wallboards 26 are, thus, each suspended, and urged firmly against the studs 20, by the hanger legs 52, of six clips 28, being supported on the channel side walls 60 and the tear-resistant strips 30 being supported, at the six slots 40 engaged by clips 28, by the tear-resistant strength of the material of strips 30.

The weight of the wallboards 26 is also partially supported by the grasping forces created by the hanger legs 52, which are being bent upward by the weight of the wallboard 26, causing the upper end 62 of curved front leg 48 to be urged firmly against the strip 30, squeezing the strip 30 between the upper end 62 and the back leg 44. To further enhance this grasping, the hanger leg and the upper end 62 of the front leg have a central raised ridge 64, and back leg 44 has a small hole 66 located so that the portion of ridge 64 which extends around bend 50 will protrude slightly into the hole 66 when the front leg 48 is urged rearward against back leg 44, resulting in essentially a locking force grasping the material of strip 30 located therebetween.

It will be understood that if wall 10 were to be a ten-foot high wall, there would be one additional channel 22 and two additional clips 28, all disposed respectively at locations 24 inches, 48 inches, 72 inches and 96 inches from the wallboard top edge 42. Wallboard top edge 42 will be seen to be at the same height as the stud top edges 68, which are disposed within the ceiling runner 16.

If the wallboards are four-feet wide, there will commonly be an additional vertical stud (not shown) located at two-foot spacings from the studs 20 at the wallboard side edges 34. In such cases, it is common to have the wallboard side edges 34 of one face 70 of the wall 10 located over alternating studs 20, between the studs (not shown) behind the wallboard edges of the other face 72 of the wall 10.

Figure 5:
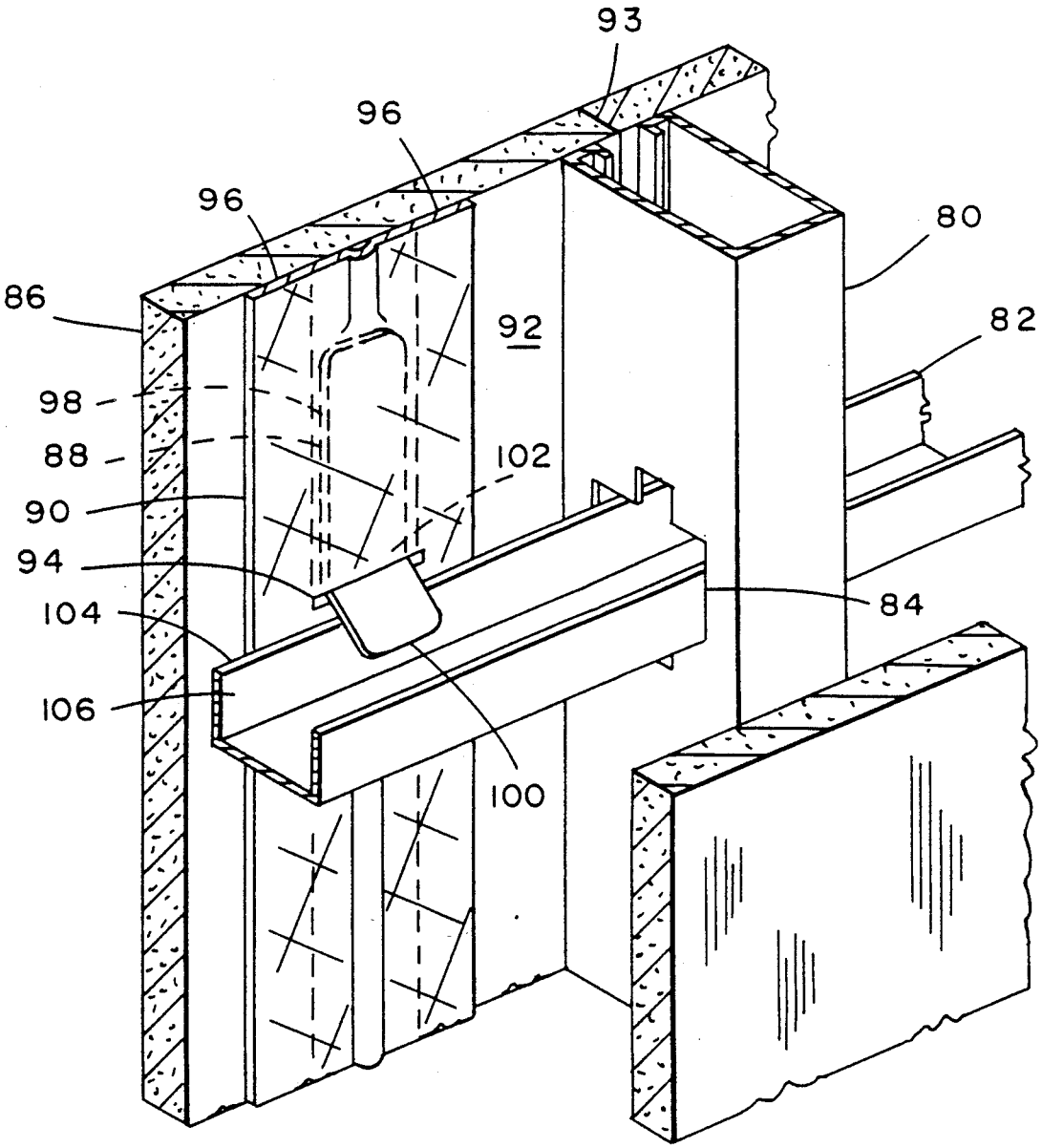
FIG. 5 is a partly broken away, isometric view, similar to FIG. 2, of a modified form of the invention.

In FIG. 5, there is shown a modified form of the invention in which a stud 80 supports a horizontal channel 82 extending through cutouts 84 in the stud 80. Wallboards 86 are supported and held firmly against studs 80 by suspension clips 88. The wallboards 86 have a tear-resistant fabric strip 90 partially adhered to the back face 92, adjacent each side edge 93 of wallboard 86.

The fabric strip 90 has a plurality of slots 94 extending laterally and centered laterally in the strip 90, which is adhered to the wallboard 86 along side edge areas 96.

The suspension clips 88 are formed of a heavy gauge, one-inch wide sheet metal and include a three-inch long, vertically extending top leg 98, connected at the bottom 102, to a hanger leg 100, which extends outwardly and downwardly from the bottom 102 of top leg 98, at an angle of about 40° to 60°, relative to the vertical top leg 98.

The top leg 98 of each clip 88 is disposed between the wallboard back face 92 and the strip 90. Each clip extends through a slot 94 at the bottom 102 of top leg 98. Each clip hanger leg 100 is disposed over the top edge 104 of an upwardly extending side wall 106 of a horizontal channel 82.

Figure 6:
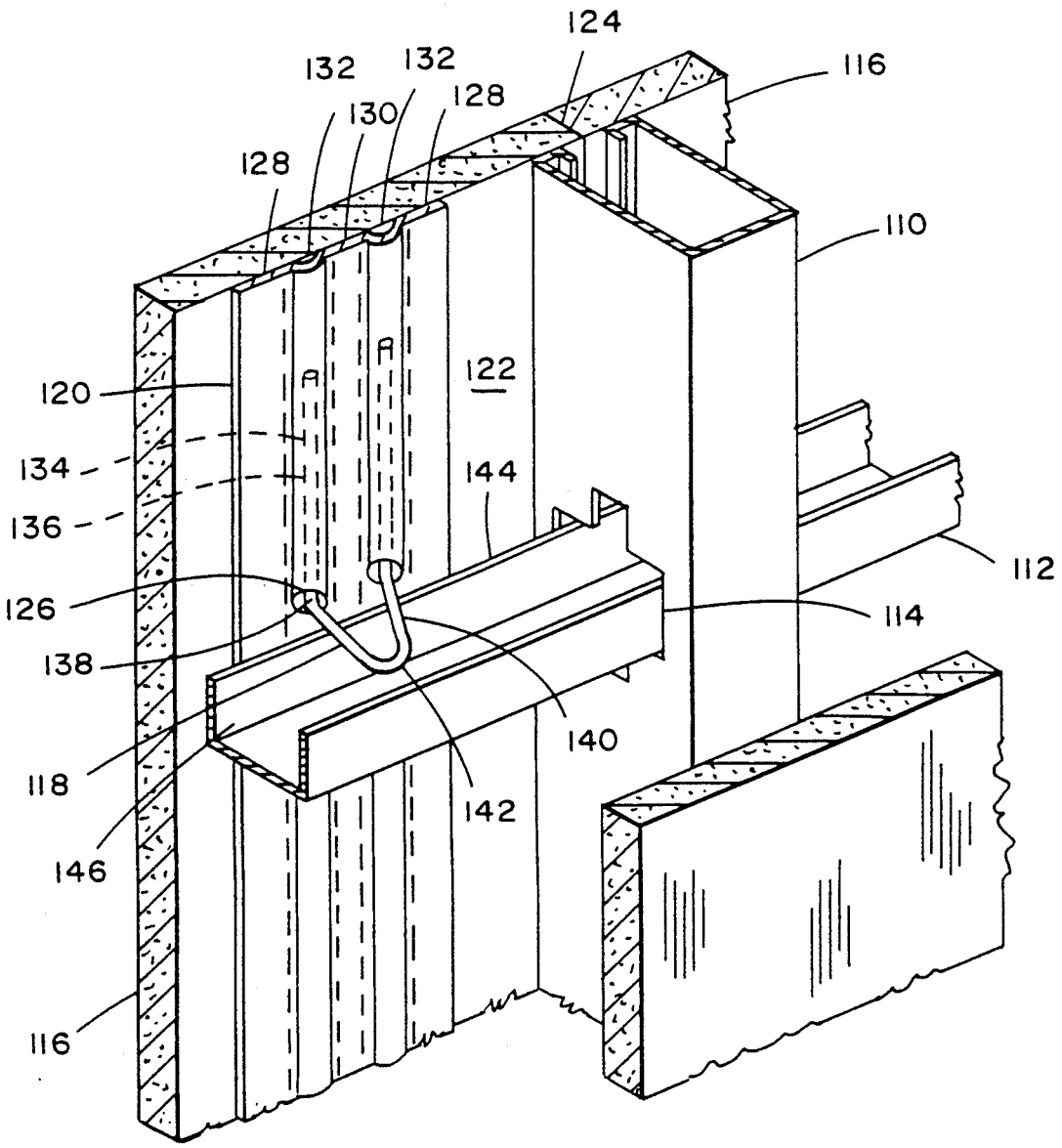
FIG. 6 is a partly broken away, isometric view, similar to FIG. 2, of a further modified form of the invention.

In FIG. 6, there is shown a still further modified form of the invention in which a stud 110 supports a horizontal channel 112 extending through cutouts 114 in the stud 110. Wallboards 116 are supported and held firmly against studs 110 by wire suspension clips 118. The wallboards 116 have a tear-resistant fabric strip 120 partially adhered to the back face 122, adjacent each side edge 124 of wallboards 116.

The fabric strip 120 has a plurality of small holes 126 arranged in laterally spaced pairs in the strip 120, which is adhered along side edge areas 128 and in a center area 130, leaving unadhered narrow areas 132 between the center area 130 and each side area 128.

The wire suspension clips 118 are formed of a heavy, rigid wire of two symmetrical side portions 134. Each side portion 134 includes a three-inch long, vertically extending top leg 136 connected at the bottom 138 to a hanger leg 140, which extends outwardly and downwardly from the bottom 138 of top leg 136, at an angle of about 40° to 60° relative to the vertical top leg 136. The hanger legs 140 of each side portion 134 are joined together at a bottom wire bend 142.

The top leg 136 of each side portion 134 of each clip 118 is disposed between the wallboard back face 122 and the strip 120, at an unadhered narrow area 132. Each side portion extends through one of the pair of small holes 126, at the bottom 138 of top leg 136. The pair of hanger legs 140 are disposed over, the top edge 144 of an upwardly extending side wall 146 of a horizontal channel 112.

In addition to the embodiments described, which incorporate an elongate tear-resistant fabric strip 30, 90 or 120, extending lengthwise on the back face 32, 92 or 122 of wallboard 26, 86 or 116, it is contemplated that the tear-resistant material could be elongate strips extending laterally across the width of the board at desired spaced locations, or, even further, the tear-resistant material could be discontinuous strips or patches. With laterally extending strips, slots, for insertion of clips 28, 88 or 118, would need to be located inward from the bottom and top edges, with unadhered areas of tear-resistant material above the slots, between adhered areas of material. The width of a laterally extending strip may need to be wider than what is required for longitudinally extending strips.

Having completed a detailed disclosure of the preferred embodiments of my invention, so that others may practice the same, I contemplate that variations may be made without departing from the essence of the invention.

I claim:

1. A wallboard comprising a flat, rectangular, rigid board, said board having a front face, a back face, two side edges and two ends, said board having thin, strong, tear-resistant material partially adhered to said back face, said tear-resistant material being disposed in at least a plurality of spaced-apart areas throughout said back face, suitable to support and retain said wallboard in place when fastening means are affixed to said material in each of said areas, said material being adhered to said back face at least in said spaced-apart areas with unadhered portions forming pockets positioned between adhered portions, whereby an upwardly extending leg of a suspension clip can be caused to pass through said material at one of said unadhered portions and to extend upward into said unadhered pocket, to support and retain said wallboard in place, wherein said thin, strong, tear-resistant material comprises a layer of non-woven synthetic fibers.

2. The wallboard of claim 1 wherein said layer comprises fibers of the group consisting of polyester and polypropylene.

3. The wallboard of claim 2 wherein said tear-resistant material is a composite of a fused, non-woven synthetic fiber ply laminated to a Kraft paper ply.

4. The wallboard of claim 1 wherein said layer further comprises fiberglass fibers.

5. The wallboard of claim 1 wherein said layer is latex impregnated.

6. A wallboard as defined in claim 1 wherein said thin, strong, tear-resistant material is spun-bonded, non-woven nylon.

7. A wallboard as defined in claim 1 wherein said thin, strong, tear-resistant material comprises a layer of non-woven fiberglass fibers.

8. A wallboard comprising a flat, rectangular, rigid board, said board having a front face, a back face, two side edges and two ends, said board having thin, strong, tear-resistant material partially adhered to said back face, said tear-resistant material being disposed in at least a plurality of spaced-apart areas throughout said back face, suitable to support and retain said wallboard in place when fastening means are affixed to said material in each of said areas, said material being adhered to said back face at least in said spaced-apart areas with unadhered portions forming pockets positioned between adhered portions, whereby an upwardly extending leg of a suspension clip can be caused to pass through said material at one of said unadhered portions and to extend upward into said unadhered pocket, to support and retain said wallboard in place, wherein said thin, strong, tear-resistant material is a thin metallic sheet of about 0.015 inch thickness.

9. A wallboard comprising a flat, rectangular, rigid board, said board having a front face, a back face, two side edges and two ends, said board having thin, strong, tear-resistant material partially adhered to said back face, said tear-resistant material being disposed in at least a plurality of spaced-apart areas throughout said back face, suitable to support and retain said wallboard in place when fastening means are affixed to said material in each of said areas, said, material being adhered to said back face at least in said spaced-apart areas with unadhered portions forming pockets positioned between adhered portions, whereby an upwardly extending leg of a suspension clip can be caused to pass through said material at one of said unadhered portions and to extend upward into said unadhered pocket, to support and retain said wallboard in place, wherein said tear-resistant material consists of a plurality of separate strips and wherein said separate strips are slotted elongate strips partially adhered to said back face and extending laterally of said wallboard back face at a plurality of longitudinally spaced locations.

10. A wallboard comprising a flat, rectangular, rigid board, said board having a front face, a back face, two side edges and two ends, said board having thin, strong, tear-resistant material partially adhered to said back face, said tear-resistant material being disposed in at least a plurality of spaced-apart areas throughout said back face, suitable to support and retain said wallboard in place when fastening means are affixed to said material in each of said areas, said material being adhered to said back face at least in said spaced-apart areas with unadhered portions forming pockets positioned between adhered portions, whereby an upwardly extending leg of a suspension clip can be caused to pass through said material at one of said unadhered portions and to extend upward into said unadhered pocket, to support and retain said wallboard in place, wherein said thin, strong, tear-resistant material consists of a plurality of small patches disposed in spaced apart locations on said wallboard back face.

11. A wallboard comprising a flat, rectangular, rigid board, said board having a front face, a back face, two side edges and two ends, said board having thin, strong, tear-resistant material partially adhered to said back face, said tear-resistant material being disposed in at least a plurality of spaced-apart areas throughout said back face, suitable to support and retain said wallboard in place when fastening means are affixed to said material in each of said areas, said material being adhered to said back face at least in said spaced-apart areas with unadhered portions forming pockets positioned between adhered portions, whereby an upwardly extending leg of a suspension clip can be caused to pass through said material at one of said unadhered portions and to extend upward into said unadhered pocket, to support and retain said wallboard in place wherein said thin, strong, tear-resistant material is a laminate including a Kraft paper.

12. A wallboard as defined in claim 11 wherein said thin, strong, tear-resistant material is a laminate of latex impregnated paper and Kraft paper.

13. A wallboard as defined in claim 11 wherein said thin, strong, tear-resistant material is a laminate of metal screen and Kraft paper.

* * * * *